US010388434B1

(12) United States Patent
Gebs

(10) Patent No.: US 10,388,434 B1
(45) Date of Patent: Aug. 20, 2019

(54) TWISTED PAIR COMMUNICATION CABLES HAVING SEPARATORS FORMED FROM A COMBINATION OF FOAMED AND UNFOAMED MATERIALS

(71) Applicant: Superior Essex International LP, Atlanta, GA (US)

(72) Inventor: Bernhart A. Gebs, Powder Springs, GA (US)

(73) Assignee: Superior Essex International LP, Atlanta, GA (US)

( * ) Notice: Subject to any disclaimer, the term of this patent is extended or adjusted under 35 U.S.C. 154(b) by 0 days.

(21) Appl. No.: 16/004,545

(22) Filed: Jun. 11, 2018

(51) Int. Cl.
*H01B 11/04* (2006.01)
*H01B 3/30* (2006.01)
*H01B 11/00* (2006.01)

(52) U.S. Cl.
CPC ..... *H01B 11/04* (2013.01); *H01B 3/307* (2013.01); *H01B 11/002* (2013.01)

(58) Field of Classification Search
CPC ..... H01B 11/04; H01B 17/14
USPC ..... 174/113 C, 113 R
See application file for complete search history.

(56) References Cited

U.S. PATENT DOCUMENTS 6,288,340 B1 * 9/2001 Arnould ..... H01B 11/085 174/113 R
8,426,732 B1 * 4/2013 Waldner ..... H01B 11/06 174/110 R
2010/0200269 A1 * 8/2010 Camp, II ..... H01B 11/04 174/113 C

* cited by examiner

*Primary Examiner* — Chau N Nguyen

(57) ABSTRACT

A communication cable may include a plurality of twisted pairs of individually insulated electrical conductors and a separator positioned between the plurality of twisted pairs. The separator may include a plurality of prongs, and each of the plurality of prongs may extend between a respective set of adjacent pairs included in the plurality of twisted pairs. Additionally, the separator may include a first of the plurality of prongs formed from a foamed polymeric material and a second of the plurality of prongs formed from a solid polymeric material. A jacket may be formed around the plurality of twisted pairs and the separator.

20 Claims, 6 Drawing Sheets

TWISTED PAIR COMMUNICATION CABLES HAVING SEPARATORS FORMED FROM A COMBINATION OF FOAMED AND UNFOAMED MATERIALS

TECHNICAL FIELD

Embodiments of the disclosure relate generally to communication cables and, more particularly, to twisted pair communication cables that include separators having a first subset of prongs formed from solid materials and a second subset of prongs formed from foamed materials.

BACKGROUND

A wide variety of different types of cables are utilized to transmit power and/or communications signals. In certain types of cables, it is desirable to provide separation for internal cable components. For example, certain cables make use of multiple twisted pairs of conductors to communicate signals. In each pair, the wires are twisted together in a helical fashion to form a balanced transmission line. When twisted pairs are placed in close proximity, such as within the core of a cable, electrical energy may be transferred from one pair of the cable to another pair. Such energy transfer between pairs is undesirable and is referred to as crosstalk. Crosstalk causes interference to the information being transmitted through the twisted pairs and can reduce the data transmission rate and cause an increase in bit rate error. Interlinking typically occurs when two adjacent twisted pairs are pressed together, and interlinking can lead to an increase in crosstalk among the wires of adjacent twisted pairs.

In order to improve crosstalk performance, separators (also referred to as separation fillers, fillers, interior supports, or splines) have been inserted into many conventional cables. Each twisted pair may be twisted to a different twist length or "lay length" in order to control interference associated with signal energy coupling between or among the pairs, including through the separator. The materials of the separator and the insulation material for the twisted pairs affect this interference. However, materials offering improved electrical performance, such as fluorinated ethylene propylene, typically have higher costs. Attempts have been made to reduce high costs materials by forming a separator from foamed materials. However, foamed materials can often become soft and may crush, for example, during processing and/or cable installation. This crushing changes separation distances between adjacent sets of twisted pairs and negatively affects crosstalk and electrical performance. Accordingly, there is an opportunity for improved separators that reduce the usage of high costs materials while maintaining desired electrical performance characteristics. Additionally, there is an opportunity for improved separators including a first subset of solid prongs or fins and a second subset of foamed prongs or fins.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures.

Additionally, the drawings are provided to illustrate example embodiments described herein and are not intended to limit the scope of the disclosure.

DETAILED DESCRIPTION

Figure 1:
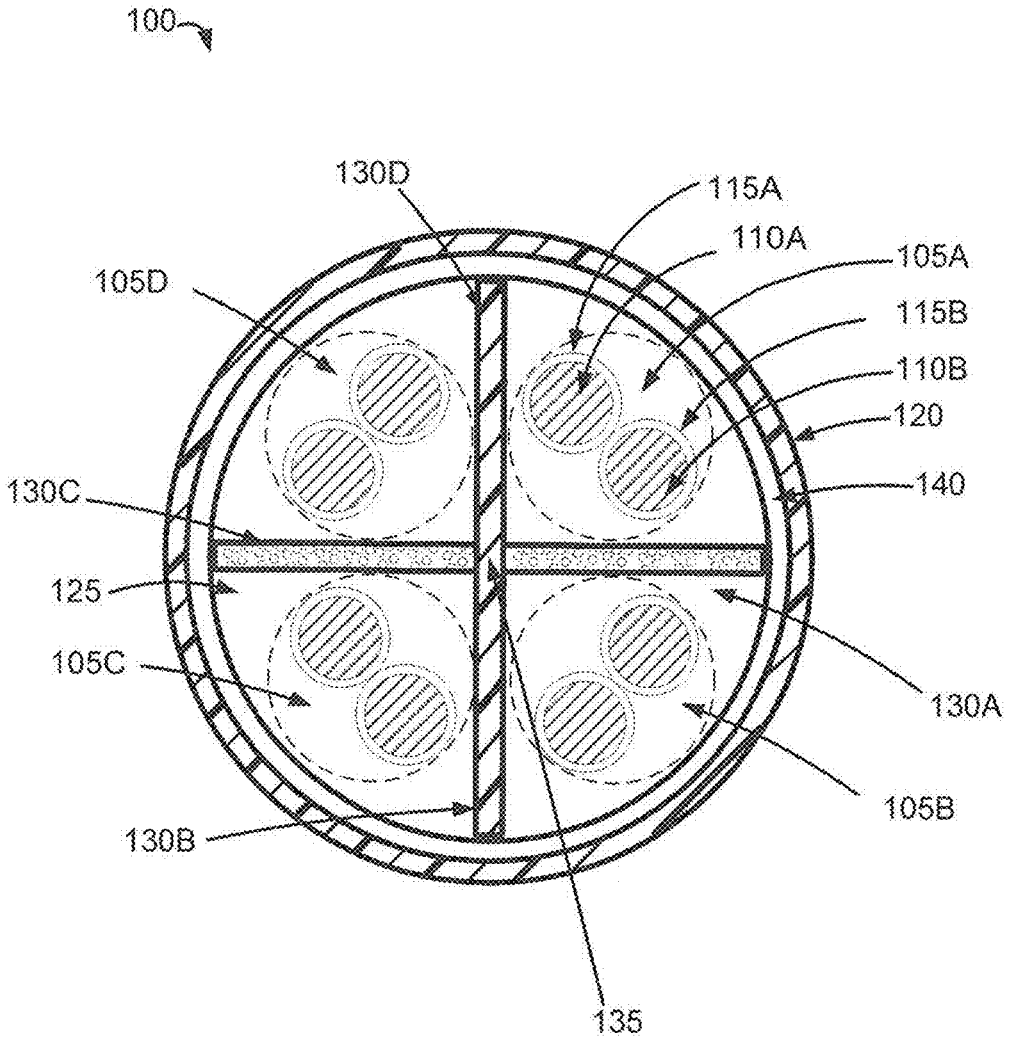
FIGS. 1-4 are cross-sectional views of example twisted pair cables that include separators having a combination of solid and foamed prongs or fins, according to illustrative embodiments of the disclosure.

Various embodiments of the present disclosure are directed to twisted pair cables that include separators having a combination of solid and foamed prongs. For example, a cable may include a plurality of twisted pairs of individually insulated electrical conductors that extend along a longitudinal direction. A separator may be positioned between the plurality of twisted pairs, and the separator may include a plurality of prongs that extend between respective sets of adjacent twisted pairs. According to an aspect of the disclosure, the separator may include a first subset of prongs formed from a foamed polymeric material and a second subset of prongs formed from a solid polymeric material. As a result, an amount of material utilized to form the separator may be reduced relative to conventional solid separators. Additionally, desired structural support and/or crush resistance may be provided for the separator. For example, prongs formed from a solid polymeric material may be positioned between adjacent sets of twisted pairs that may be more susceptible to crushing and/or mechanical deformation.

As desired in various embodiments, a separator may include any suitable number of solid and/or foamed prongs or fins. Utilizing an example cable that includes four twisted pairs, a separator may be formed as a cross-filler having four prongs that respectively extend between each adjacent set of twisted pairs. In certain embodiments, the separator may include two prongs formed from a foamed polymeric material and two prongs formed from a solid polymeric material. For example, two foamed prongs may extend in opposite directions from one another while two solid prongs formed perpendicular to the foamed prongs extend in opposite directions from one another. As another example, two foamed prongs may extend in perpendicular directions from one another. In other embodiments, the separator may include one prong formed from a foamed polymeric material and three prongs formed from a solid polymeric material. In yet other embodiments, the separator may include three prongs formed from a foamed polymeric material and one prong formed from a solid polymeric material.

Additionally, a wide variety of suitable materials may be utilized to form a separator and/or its prongs. For example, the separator may be formed from fluorinated ethylene propylene ("FEP"), polyvinylidene fluoride ("PVDF"), and/or a wide variety of other suitable polymeric materials or combinations of materials. In certain embodiments, the solid and the foamed prongs may be formed from the same material. Additionally, one or more foamed prongs may be formed with any suitable foam rate. In the event that the separator includes a plurality of foamed prongs, in certain embodiments, the plurality of foamed prongs may be formed with similar or approximately equal foam rates. In other embodiments, at least two foamed prongs may be formed with different foam rates. For example, foam rates may be adjusted in order to provide prongs with varying crush resistance. Further, as desired in certain embodiments, a suitable skin layer may be provided for one or more foamed prongs. In other words, a layer formed from a solid polymeric material may be formed over a foamed prong. For purposes of this disclosure, the terms "foamed prong", "prong formed from a foamed polymeric material", and/or similar terms encompass foamed prongs that include and that fail to include a solid polymeric skin layer.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

FIGS. 1-4 are cross-sectional views of example twisted pair cables that include separators having a combination of solid and foamed prongs or fins, according to an illustrative embodiment of the disclosure. Each of these example cables may include similar components. For example, each example cable may include a cross-filler separator positioned between a plurality of twisted pairs. The separators may include respective prongs that extend between each adjacent set of twisted pairs. However, the separators of the different example cables of FIGS. 1-4 may include different numbers and/or configurations of foamed and/or solid prongs. Each of the example cables of FIGS. 1-4 are discussed in greater detail below. Although greater detail is provided for the cable of FIG. 1, it will be appreciated that components of other cables may be similar to those described with reference to FIG. 1.

With reference to FIG. 1, a cross-section of a first example cable 100 that includes a separator having a combination of solid and foamed prongs or fins is illustrated. The cable 100 is illustrated as a twisted pair communications cable; however, embodiments of the disclosure may additionally be applicable to other types of cables that incorporate separators, such as composite or hybrid cables that include a combination of twisted pairs and other transmission media (e.g., optical fibers, etc.). Indeed, suitable cables may include any number of transmission media including but not limited to one or more twisted pairs, optical fibers, coaxial cables, and/or power conductors. Further, embodiments of the disclosure may be utilized in association with horizontal cables, vertical cables, flexible cables, equipment cords, cross-connect cords, plenum cables, riser cables, power over Ethernet, or any other appropriate cables.

As shown in FIG. 1, the cable 100 may include four twisted pairs 105A, 105B, 105C, 105D; however, any other suitable number of pairs may be utilized. Each twisted pair (referred to generally as twisted pair 105) may include two electrical conductors 101A, 110B, each covered with respective insulation 115A, 115B. The electrical conductors (generally referred to as conductor 110) of a twisted pair 105 may be formed from any suitable electrically conductive material, such as copper, aluminum, silver, annealed copper, gold, a conductive alloy, etc. In certain embodiments, one or more electrical conductors may also be coated with another material (e.g., tinned copper, etc.) Additionally, the electrical conductors 110 may have any suitable diameter, gauge, and/or other dimensions. Further, each of the electrical conductors 110 may be formed as either a solid conductor or as a conductor that includes a plurality of conductive strands that are twisted together.

The twisted pair insulation (generally referred to as insulation 115) may include any suitable dielectric materials and/or combination of materials. Examples of suitable dielectric materials include, but are not limited to, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins, a low smoke zero halogen ("LSZH") material, etc.), nylon, polyurethane, neoprene, cholorosulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 105A-D may be formed from similar materials. For example, in a plenum cable, each of the twisted pairs 105A-D may include FEP insulation. In other embodiments, at least two of the twisted pairs may utilize different insulation materials. In yet other embodiments, the two conductors that make up a twisted pair 105 may utilize different insulation materials. As desired in certain embodiments, insulation may additionally include a wide variety of other materials (e.g., filler materials, materials compounded or mixed with a base insulation material, etc.), such as smoke suppressant materials, flame retardant materials, etc.

In various embodiments, twisted pair insulation 115 may be formed from one or multiple layers of insulation material. A layer of insulation may be formed as solid insulation, unfoamed insulation, foamed insulation, or other suitable insulation. As desired, combinations of different types of insulation may be utilized. For example, a foamed insulation layer may be covered with a solid foam skin layer. As desired with foamed insulation, different foaming levels may be utilized for different twisted pairs in accordance with twist lay length to assist in balancing propagation delays between the twisted pairs. Additionally, the insulation 115 may be formed with any suitable thickness, inner diameter, outer diameter, and/or other dimensions.

Each twisted pair 105 can carry data or some other form of information, for example in a range of about one to ten Giga bits per second ("Gbps") or other suitable data rates, whether higher or lower. In certain embodiments, each twisted pair 105 supports data transmission of about two and one-half Gbps (e.g. nominally two and one-half Gbps), with the cable 100 supporting about ten Gbps (e.g. nominally ten Gbps). In certain embodiments, each twisted pair 105 supports data transmission of up to about ten Gbps (e.g. nominally ten Gbps), with the cable 100 supporting about forty Gbps (e.g. nominally forty Gbps).

Each twisted pair 105 may also be formed with any suitable twist lay. In certain embodiments, each of the twisted pairs 105A-D may be formed with similar or approximately equal twist lays. In other embodiments, a desired number of the twisted pairs 105A-D may be formed with different respective twist lays. For example, each of the twisted pairs 105A-D may have a different twist lay. The different twist lays may function to reduce crosstalk between the twisted pairs, and a wide variety of suitable twist lay configurations may be utilized. In certain embodiments, the respective twist lays for the twisted pairs 105A-D may be selected, calculated, or determined in order to result in a cable 100 that satisfies one or more standards and/or electrical requirements. For example, twist lays may be selected such that the cable 100 satisfies one or more electrical requirements of a Category 5, Category 5e, Category 6, Category 6A. or other suitable standard. Twist lays may be selected in order to satisfy a wide variety of other electrical requirements as desired in various embodiments.

In certain embodiments, the differences between twist lays of twisted pairs 105 that are circumferentially adjacent one another (for example the twisted pair 105A and the twisted pair 105B) may be greater than the differences between twist lays of twisted pairs 105 that are diagonal from one another (for example the twisted pair 105A and the twisted pair 105C). As a result of having similar twist lays, the twisted pairs that are diagonally disposed can be more susceptible to crosstalk issues than the twisted pairs 105 that are circumferentially adjacent; however, the additional distance between the diagonally disposed pairs may limit the crosstalk. Thus, the different twist lays and arrangements of the pairs can help reduce crosstalk among the twisted pairs 105. As desired, the plurality of twisted pairs 105A-D may be twisted together with an overall twist or bunch. Any suitable overall twist lay or bunch lay may be utilized. Further, in certain embodiments, each of the twisted pairs 105A-D may be twisted in the same direction (e.g., clockwise, counter clockwise, etc.). In other embodiments, at least two of the twisted pairs 105A-D may be twisted in opposite directions. Additionally, a overall twist may be formed in any suitable direction. Indeed, a wide variety of suitable twist lays and twist directions may be utilized as desired in various embodiments.

As desired in certain embodiments, one or more suitable bindings or wraps may be wrapped or otherwise formed around the twisted pairs 105A-D once they are twisted together. Additionally, in certain embodiments, multiple grouping of twisted pairs may be incorporated into a cable. As desired, each grouping may be twisted, bundled, and/or bound together. Further, in certain embodiments, the multiple groupings may be twisted, bundled, or bound together.

With continued reference to FIG. 1, a jacket 120 may enclose the internal components of the cable 100, seal the cable 100 from the environment, and/or provide strength and structural support. The jacket 120 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers. MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. For example, a PVC jacket or a jacket containing PVC material may be used in certain embodiments. The jacket 120 may be formed as a single layer or, alternatively, as multiple layers. In certain embodiments, the jacket 120 may be formed from one or more layers of foamed material. As desired, the jacket 120 can include flame retardant and/or smoke suppressant materials. The jacket 120 may be formed to result in a round cable or a cable having an approximately circular cross-section; however, the jacket 120 and internal components may be formed to result in other desired shapes, such as an elliptical, oval, or rectangular shape. The jacket 120 may also have a wide variety of suitable dimensions, such as any suitable or desirable outer diameter and/or any suitable or desirable wall thickness. In various embodiments, the jacket 120 can be characterized as an outer jacket, an outer sheath, a casing, a circumferential cover, or a shell.

An opening enclosed by the jacket 120 may be referred to as a cable core, and the twisted pairs 105A-D and/or other cable components may be disposed within the cable core. Although a single cable core is illustrated in the cable 100 of FIG. 1, a cable may be formed to include multiple cable cores. In certain embodiments, the cable core may be filled with a gas such as air (as illustrated) or alternatively a gelatinous, solid, powder, moisture absorbing material, water-swellable substance, dry filling compound, or foam material, for example in interstitial spaces between the twisted pairs 105A-D. Other elements can be added to the cable core as desired, for example one or more optical fibers, additional electrical conductors, additional twisted pairs, water absorbing materials, and/or strength members, depending upon application goals.

According to an aspect of the disclosure, a suitable separator 125, spline, or filler may be positioned between two or more of the twisted pairs 125. The separator 125 may be disposed within the cable core and configured to orient and or position one or more of the twisted pairs 105A-D. The orientation of the twisted pairs 105A-D relative to one another may provide beneficial signal performance. As desired in various embodiments, the separator 125 may be formed in accordance with a wide variety of suitable dimensions, shapes, or designs. For example, as shown in FIG. 1, the separator 125 may be formed as an X-shaped separator or cross-filler. A cross-filler separator 125 may be viewed as including a plurality of prongs, projections, or fins that extend in different directions from a central portion, spine, or central point. Although cross-filler or X-shaped separators are generally described herein, a wide variety of other suitable separators may be formed that include a plurality of prongs or fins. For example, a flat separator (e.g., a separator that bisects a cable core), a T-shaped separator, a Y-shaped separator, a J-shaped separator, an L-shaped separator, or any other suitable separator having any number of prongs, fins, or projections extending from a central point may be utilized as desired in various embodiments.

In certain embodiments, one or more prongs or fins of the separator 125 may extend between or partially between one or more respective or corresponding sets of adjacent twisted pairs. For example, each prong of a separator 125 may extend between a respective set of adjacent twisted pairs. With reference to the illustrated cross-filler separator 125, a first prong 130A may extend between a first twisted pair 105A and a second twisted pair 105B, a second prong 130B may extend between the second twisted pair 105B and a third twisted pair 105C, a third prong 130C may extend between the third twisted pair 105C and a fourth twisted pair 105D, and a fourth prong 130D may extend between the fourth twisted pair and the first twisted pair 105A.

Each prong or projection (generally referred to as prong 130) may be formed with a wide variety of suitable dimensions. For example, each prong 130 may have a wide variety of suitable cross-sectional shapes at a given cross-sectional point perpendicular to a longitudinal direction of the separator 125. As shown in FIG. 1, each prong 130 may have a rectangular or approximately rectangular cross-sectional shape at a cross-sectional point perpendicular to the longitudinal direction. In other embodiments, one or more prongs 130 may have a triangular, approximately triangular, arcuate, semi-circular, trapezoidal, or other suitable cross-sectional shape at a cross-sectional point perpendicular to the longitudinal direction. As another example, each prong 130 may have any suitable cross-sectional shape taken along the longitudinal direction (e.g., rectangular, square, semi-circular, parallelogram, trapezoidal, triangular, etc.). As discussed in greater detail below, in various embodiments, prongs 130 may be longitudinally continuous along a length of the separator 125 or, alternatively, prongs 130 may be discontinuous or segmented along the longitudinal length. Accordingly, each prong 130 may be formed with any suitable longitudinal length.

As another example, each prong 130 may be formed with any suitable distance of projection or length of extension from a central point or central portion of the separator 125. In other words, a prong 130 may extend any suitable distance from a central point between a set of adjacent twisted pairs. In certain embodiments, a prong 130 may extend a distance that is approximately equal to 0.25, 0.50, 0.75, or 1.0 times the diameter of a twisted pair 105, a distance included in a range between any two of the above values, or a distance included in a range bounded on a minimum or maximum end by one of the above values. In other embodiments, a prong 130 may have a distance of projection that causes the prong 130 to extend beyond two adjacent twisted pairs and/or beyond a circumference of the twisted pairs 105A-D. As desired, an extending portion of the prong 130 (e.g., a portion extending beyond the twisted pairs 105A-D) may be wrapped or curled around an outer periphery of the twisted pairs 105A-D. In this regard, the prong 130 may provide shielding for the twisted pairs 105A-D and/or spacing between the twisted pairs 105A-D and the outer jacket 120 (e.g., additional spacing to reduce alien crosstalk with other cables, etc.).

Additionally, each prong 130 may have any suitable thickness. In certain embodiments, a separation distance between an adjacent set of twisted pairs may be determined based at least in part on the thickness of a prong 130 positioned between the adjacent twisted pairs, as well as the materials that are utilized to form the prong 130. As desired, a thickness of a prong 130 may be determined or sized in order to achieve a desired separation distance between two adjacent twisted pairs. In certain embodiments, a prong 130 may be formed with a relatively uniform thickness. In other embodiments, a prong 130 may be formed with a varying thickness (e.g., a tapered thickness, a thickness that results in ribs being formed on one or both surfaces of a prong facing an adjacent twisted pair, etc.).

In certain embodiments, each prong 130A-D may be formed with substantially similar dimensions (e.g., cross-sectional shape(s), distance of projection, thickness, etc.). In other embodiments, at least two prongs may be formed with different dimensions. For example, two prongs may be formed with different thicknesses in order to provide desired separation distances between two different sets of adjacent twisted pairs. In certain embodiments, certain materials and/or construction techniques (e.g., solid or foamed) utilized to form two prongs may result in the prongs being more susceptible to crushing. Accordingly, the thicknesses of the prongs may be sized accordingly in order to provide desired separation distances. As another example, two prongs may be formed with different distances of projection. For example, a first prong may only extend between two adjacent twisted pairs while a second prong extends beyond the twisted pairs and is wrapped around an outer periphery of the twisted pairs. A wide variety of other dimensions may be varied between any two prongs as desired.

According to an aspect of the disclosure, a first subset of the separator prongs may be formed from foamed polymeric material and a second subset of the separator prongs may be formed from solid polymeric material. For example, as shown in the cross-filler separator 125 of FIG. 1, two prongs 130A, 130C may be formed from foamed polymeric material while the other two prongs 130B, 130D may be formed from solid polymeric material. As a result of firming a subset or first portion of the prongs 130A-D from foamed material, an amount of material utilized to form the separator 125 may be reduced relative to conventional solid separators. For example, with a separator formed from a relatively expensive material (e.g., FEP, PVDF, etc.), an amount of required material may be reduced and, therefore, a cost of the separator may be reduced.

Figure 2:
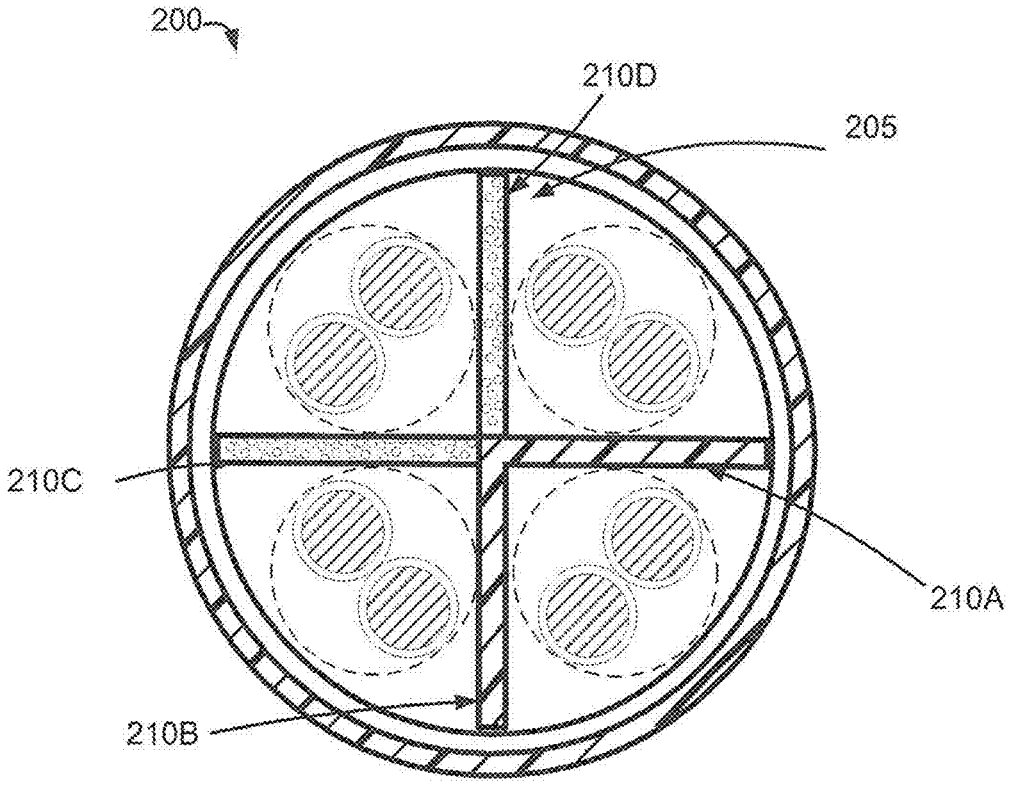
Figure 3:
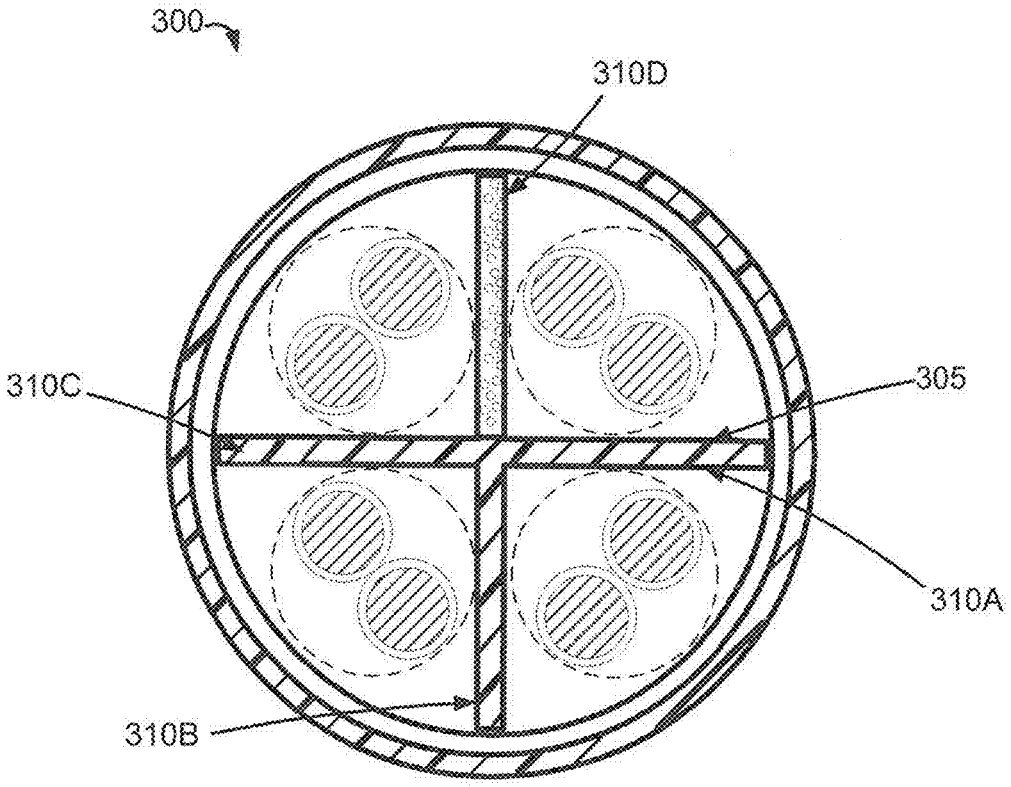
Figure 4:
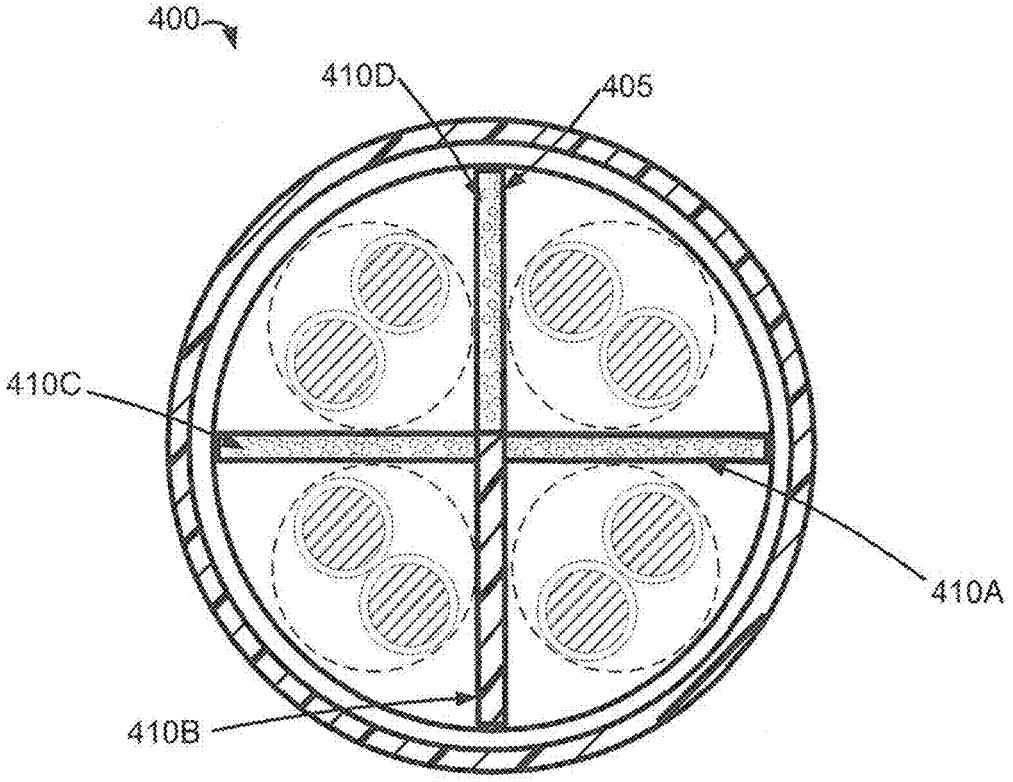

The separator 125 may include any suitable number of solid and/or foamed prongs or fins. Additionally, the various prongs may be configured in any suitable orientation. In certain embodiments, the separator 125 may include two prongs formed from a foamed polymeric material and two prongs formed from a solid polymeric material. For example, as shown in FIG. 1, two foamed prongs 130A, 130C may extend in opposite directions from one another while two solid prongs 130B, 130D formed perpendicular to the foamed prongs 130A, 130C extend in opposite directions from one another. As another example, as shown in FIG. 2, a separator may include two foamed prongs that extend in perpendicular directions from one another and two solid prongs that extend in perpendicular direction from one another. Further, a first of the solid prongs may extend in an opposite direction from a first of the foamed prongs while a second of the solid prongs may extend in an opposite direction from a second of the foamed prongs. In other embodiments, as shown in FIG. 3, a separator may include one prong formed from a foamed polymeric material and three prongs formed from a solid polymeric material. In yet other embodiments, as shown in FIG. 4, a separator may include three prongs formed from a foamed polymeric material and one prong formed from a solid polymeric material. A wide variety of other suitable configurations may be utilized as desired.

When a separator 125 is incorporated into a cable 100, the various prongs 130A-D of the separator 125 extend between respective sets of adjacent twisted pairs. Additionally, the separator 125 is typically helically twisted with the twisted pairs 105A-D when an overall twisting or bunching operation is performed. In certain embodiments, certain twisted pairs (e.g., twisted pairs with certain twist lays, etc.) and/or the overall twisting or bunching may impart crushing forces onto one or more prongs of the separator 125. These crushing forces may deform or damage one or more prongs formed from foamed material. Accordingly, in certain embodiments, one or more prongs that are subject to relatively higher crushing or compressive forces may be formed from solid polymeric material rather than foamed polymeric material. As a result, desired structural support and/or crush resistance may be provided for the separator 125. For example, prongs formed from a solid polymeric material may be positioned between certain adjacent sets of twisted pairs that may be more susceptible to crushing and/or mechanical deformation. The selection or identification of solid prongs during cable design may depend on a wide variety of suitable factors, such as the twist lays of various twisted pairs, the overall twist lay, the twist directions of the various twisted pairs, the twist direction of the overall twist, the insulation thickness of the twisted pairs, the material(s) utilized to form the separator prongs, etc. Additionally, as desired in certain embodiments, one or more prongs that are subject to higher crushing and/or compressive forces may be formed with a greater thickness than other prongs.

With continued reference to the separator 125, a central portion 135 of the separator 125 may be positioned between the plurality of prongs 130A-D, and the plurality of prongs 130A-D may be viewed as extending from the central portion 135. In certain embodiments, a central portion 135 of the separator 125 may be formed from solid polymeric material. For example, the same material utilized to form one or more solid prongs may be utilized to form a central portion 135 of the separator 125. In one example embodiment, the central portion 135 may be extruded from a solid polymeric material at the same time that one or more solid prongs are extruded. As desired, one or more solid prongs may be formed with a distance of projection that results in the one or more prongs extending into a central area between the plurality of prongs 130A-D. In other words, sections of the one or more solid prongs may occupy or form the central portion 135. In other embodiments, the central portion 135 may be formed from a different solid polymeric material than that utilized to form one or more solid prongs. In yet other embodiments, the central portion 135 may be formed from a foamed polymeric material.

A wide variety of suitable materials and/or combinations of materials may be utilized to form a separator 125, its prongs 130A-D, and/or any other portions or components of the separator 125. In various embodiments, the separator 125 may include or be formed from one or more polymeric materials, one or more polyolefins (e.g., polyethylene, polypropylene, etc.), one or more fluoropolymers (e.g., fluorinated ethylene propylene ("FEP"), polyvinylidene fluoride ("PVDF"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, chlorosulphonated polyethylene, flame retardant PVC, low temperature oil resistant PVC, flame retardant polyurethane, flexible PVC, or any other suitable material or combination of materials. As desired, the separator 125 may or may not include additives (e.g., flame retardant and/or smoke suppressant materials, etc.) blended or incorporated into the polymeric material. In certain embodiments, the separator 125 may include one or more embedded or otherwise associated strength members, fibers, threads, and/or yarns. Further, in certain embodiments, the separator 125 may include or incorporate one or more shielding materials, such as electrically conductive shielding material, semi-conductive material, and/or dielectric shielding material (e.g., ferrite ceramic material, etc.). For example, one or more patches of shielding material may be formed on an outer surface of the separator 125. As another example, shielding material may be embedded into the separator 125. As a result of incorporating shielding material, the separator 125 may function as a shielding element.

In certain embodiments, the separator 125 may be formed from fluorinated ethylene propylene ("FEP"), polyvinylidene fluoride ("PVDF"), and/or a wide variety of other relatively high cost polymeric materials and/or combinations of materials. In certain embodiments, the foamed prongs 130A, 130C and the solid prongs 130B, 130D may be formed from the same polymeric material. For example, the foamed and solid prongs may both be formed from FEP. In other embodiments, the foamed prongs 130A, 130C and the solid prongs 130B, 130D may be formed from different polymeric materials. Further, in certain embodiments, each of a plurality of solid prongs may be formed from the same polymeric material. In other embodiments, at least two solid prongs may be formed from different polymeric materials. Similarly, in certain embodiments, each of a plurality of foamed prongs may be formed from the same polymeric material. In other embodiments, at least two foamed prongs may be formed from different polymeric materials.

Further, as desired in certain embodiments, a suitable skin layer may be provided for one or more foamed prongs 130A, 130C. In other words, a relatively thin "skin" layer formed from a solid polymeric material may be formed over a foamed prong. In certain embodiments, the "skin" layer may be formed from the same polymeric material as the underlying foamed base layer. For example, foamed FEP may be covered with an FEP "skin" layer. In other embodiments, the "skin" layer may be formed from a different polymeric material than that used for the underlying foamed base layer. For example, foamed FEP may be covered with a nylon "skin" layer. For purposes of this disclosure, the terms "foamed prong". "prong formed from a foamed polymeric material", and/or similar terms encompass both foamed prongs that include a solid polymeric skin layer and foamed prongs that do not include a solid polymeric skin layer.

Additionally, one or more foamed prongs 130A, 130D may be formed with any suitable foam rate. For example, a foamed prong may be formed with a foam rate of approximately 3, 5, 7, 10, 12, 15, 18, 20, 22, 25, 28, 30, 35, 40, 45, or 50 percent, a foam rate included in a range between any two of the above values, or a foam rate included in a range bounded on either a minimum or maximum end by one of the above values. In the event that the separator 125 includes a plurality of foamed prongs, in certain embodiments, the plurality of foamed prongs may be formed with similar or approximately equal foam rates. In other embodiments, at least two foamed prongs may be formed with different foam rates. For example, foam rates may be adjusted in order to provide prongs with varying crush resistance. In yet other embodiments, at least two sections of the same prong may be formed with different foam rates.

A wide variety of suitable techniques may be utilized to form a separator 125 and/or various prongs of the separator 125. In certain embodiments, material may be extruded in order to form the separator 125. For example, a dual extrusion or co-extrusion process may be utilized to extrude the foamed and solid prongs and/or other components of the separator 125. In one example embodiments, a first extrusion head or other suitable extrusion device may be utilized to extrude the solid prongs 130B, 130D and/or the central portion 135 of the separator 125. A second extrusion head or other suitable extrusion device may be utilized to separately extrude (e.g., simultaneously co-extrude, subsequently extrude onto the solid components, etc.) the foamed prongs 130A, 130C. As desired, one or more gases (e.g., nitrogen, air, etc.) and/or chemical foaming agents may be injected into or otherwise added to extruded polymeric material in order to form foamed material. Additionally, as desired, an additional extrusion process may be utilized to form a "skin" layer on one or more foamed components and/or around an entire separator 125 (i.e., a combination of foamed and solid components).

In other embodiments, various components of a separator 125 (e.g., various prongs, etc.) may be separately formed, and then the components of the separator 125 may be joined or otherwise attached together via adhesive, bonding (e.g., ultrasonic welding, etc.), or physical attachment elements (e.g., staples, pins, etc.). A wide variety of other suitable construction techniques may be utilized as desired. Additionally, in certain embodiments, a separator 125 may be formed to include one or more hollow cavities that may be filled with air or some other gas, moisture mitigation material, one or more optical fibers, one or more metallic conductors (e.g., a drain wire, etc.), shielding, or some other appropriate material or element.

In certain embodiments, the separator 125 may be continuous along a longitudinal length of the cable 100. In other embodiments, the separator 125 may be non-continuous or discontinuous along a longitudinal length of the cable 100. In other words, the separator 125 may be separated, segmented, or severed in a longitudinal direction such that discrete sections or portions of the separator 125 are arranged longitudinally (e.g., end to end) along a length of the cable 100. Use of a non-continuous or segmented separator may enhance the flexibility of the cable 100, reduce an amount of material incorporated into the cable 100, and/or reduce cost. In certain embodiments, each segment of a severed or subdivided separator 125 may be formed from similar materials. In other embodiments, a separator 125 may make use of alternating materials in adjacent portions or segments. For example, a first portion or segment of the separator 125 may be formed from solid materials, and a second portion or segment of the separator 125 may be formed from a combination of solid and foamed materials (e.g., a first subset of foamed prongs and a second subset of solid prongs). As another example, different numbers of prongs may be formed as foamed prongs in adjacent segments or portions of the separator 125. As yet another example, the positions of foamed prongs may be alternated or otherwise varied between adjacent segments or portions of the separator 125. Varying the positions of foamed prongs or foamed sections along a longitudinal length of the separator 125 may permit the solid prongs or sections to provide adequate crush resistance.

Additionally, in certain embodiments, the prongs 130A-D of a separator 125 may be continuous along a longitudinal length of the separator 125 (or a separator section in a severed separator). In other embodiments, one or more prongs 130A-D of a separator 125 may have sections or portions that are spaced along a longitudinal length of the separator 125, and any suitable longitudinal gap or spacing may be positioned between longitudinally adjacent sections of a given prong 130. Longitudinal gaps utilized between section of a prong 130 may have any suitable lengths or sizes, and gaps may be approximately equal in length and/or spacing (e.g., arranged in accordance with a desired pattern, etc.) or alternatively, arranged in a random or pseudo-random manner. The use of longitudinal spaces between adjacent sections of a prong 130 or between adjacent sets of prongs (e.g., spaced grouping of projections or prongs) may facilitate a reduction in material utilized to form the separator 125 and/or may enhance the flexibility of the separator 125 and the cable 100. As desired, different longitudinally spaced segments of a prong 130 may be formed from the same material (e.g., a solid polymeric material, a foamed polymeric material, etc.). In other embodiments, at least two longitudinally spaced segments of a prong 130 may be formed from different materials. For example, a first longitudinally spaced section of a prong 130 may be formed from a solid polymeric material while a second longitudinally spaced section of the prong 130 may be formed from a foamed polymeric material.

In yet other embodiments, a plurality of different portions or segments may be formed within a longitudinally continuous prong 130. For example, a first portion or segment of a prong 130 may be formed from a solid polymeric material while a second portion or segment of the prong 130 may be formed from a foamed polymeric material. Any suitable configuration of solid and/or foamed portions of a prong 130 may be formed as desired in various embodiments. For example, a prong 130 may alternate between solid and foamed portions along its longitudinal length. In certain embodiments, the various sections may have similar longitudinal lengths. In other embodiments, at least two sections may have different longitudinal lengths. For example, solid and foamed portions may have longitudinal lengths that are optimized in order to provide a desired crush resistance for the overall prong 130.

In yet other embodiments, a prong 130 may include a combination of solid and foamed portions along its distance of projection from a center of the separator 125. For example, an inner portion of a prong 130 positioned between two adjacent twisted pairs may be formed from a solid polymeric material while an outer or extending portion of the prong 130 that extends beyond the two adjacent twisted pairs may be formed from a foamed polymeric material. The foamed portion of the prong 130 may then be wrapped or partially wrapped around an outer periphery of the twisted pairs 105A-D. As another example, a first portion of a prong 130 positioned between two twisted pairs may be foamed while a second portion of a prong 130 positioned between the two twisted pairs may be solid. A wide variety of other constructions may be formed in which a prong includes a combination of foamed and solid sections along its distance of projection.

Additionally, in certain embodiments, at any given location along a longitudinal length of the separator 125 at which prongs extend from a central portion (e.g., separators with continuous prongs, separators with spaced sections or groupings of prongs, etc.), respective prongs 130A-D may extend between each adjacent set of twisted pairs 105A-D. For a cross-filler, prongs may extend in four directions between each of the four sets of adjacent twisted pairs. In other embodiments, prongs may extend from a central portion in different sets of one or more directions at different longitudinally spaced locations. For example, a first set of one or more prongs may extend in a first set of respective directions. A second set of one or more prongs longitudinally adjacent to the first set may extend in a second set of respective directions, and at least one direction of extension in the second set may be different than the direction(s) of extension included in the first set. Regardless of whether longitudinal gaps are positioned between various sets of longitudinally spaced prongs, any suitable number of prongs (e.g., one, two, three, four, etc.) may extend at each longitudinally spaced location. In certain embodiments, directions of extension may be varied in order to reduce material utilized to form the separator 125 while still providing a separator 125 with a desired overall cross-sectional shape. For example, a separator 125 may function as a cross-filler that includes prongs extending in four directions along a longitudinal length; however, at any given location along the longitudinal length, prongs may not extend in all four directions. Further, the various prongs may be formed from solid and/or foamed materials as desired in order to reduce material incorporated into the separator 125 and/or to provide desired crush resistance and structural performance.

A wide variety of suitable configurations of prongs may be utilized as desired if directions of extension are varied. For example, a single prong may extend from each longitudinally spaced location, and the prongs may alternate directions of extension, for example, at approximately ninety degree (90°) angles or in accordance with any other suitable pattern. As another example, two prongs may extend from each longitudinally spaced location in opposite directions from a central portion, and the directions of extension may alternate by approximately one hundred and eighty degrees (180°) between adjacent spaced locations. As another example, two prongs may extend from each longitudinally spaced location with an approximately ninety degree (90°) angle between the two projections. The directions of extension for the two prongs may then be varied between adjacent longitudinally spaced locations. As yet another example, three prongs may extend from each longitudinally spaced location, and a projection that is not present may be alternated or otherwise varied along a longitudinal length. For example, a projection that is not present may be alternated at approximately ninety degree (90°) angles at adjacent longitudinally spaced locations. Additionally, in certain embodiments, the same number of prongs may extend from each of the longitudinally spaced locations. In other examples, different numbers of prongs may extend from at least two longitudinally spaced locations. A wide variety of other prong configurations and/or variations may be utilized as desired.

With continued reference to the cable 100 of FIG. 1, in certain embodiments, one or more shield elements or shielding elements may be incorporated into the cable 100. Each shielding element may incorporate one or more shielding materials, such as electrically conductive shielding material, semi-conductive material, and/or dielectric shielding material (e.g., ferrite ceramic material, etc.). As shown in FIG. 1, an overall shield 140 or shield layer may be formed around the plurality of twisted pairs 105A-D and the separator 125. In other embodiments, individual shield layers may be respectively formed around each of the twisted pairs 105A-D. In yet other embodiments, a combination of individual shields and an overall shield 140 may be utilized. As set forth above, shielding material may also be incorporated into the separator 125. For example, shielding material may be formed on an outer surface of the separator 125 (e.g., on the surface of one or more prongs, etc.). As another example, shielding material may be embedded or otherwise incorporated into the separator 125. Similarly, shielding material may be incorporated into separation elements (e.g., film layers, etc.) that are positioned between the individual conductors of one or more twisted pairs 105A-D. Indeed, a wide variety of suitable shielding configurations, shield elements, and/or combinations of shield elements may be utilized.

In certain embodiments, a shield layer, such as the shield layer 140 illustrated in FIG. 1, may be positioned within a cable core. In other embodiments, a shield layer may be incorporated into the outer jacket 120. For example, a shield layer may be sandwiched between two other layers of outer jacket material, such as two dielectric layers. As another example, electrically conductive material or other shielding material may be injected or inserted into the outer jacket 120 or, alternatively, the outer jacket 120 may be impregnated with shielding material. A wide variety of other suitable shielding arrangements may be utilized as desired in other embodiments. Further, in certain embodiments, a cable may include a separate armor layer (e.g., a corrugated armor, etc.) for providing mechanical protection.

The external or overall shield 140 will now be described herein in greater detail; however, it will be appreciated that other shield layers may have similar constructions and/or shielding material configurations. For example, shielding patch, material configurations, and/or formation techniques described for the overall shield 140 may be similar utilized in association with the separator 125. In certain embodiments, a shield 140 may be formed from a single segment or portion that extends along a longitudinal length of the cable 100. In other embodiments, a shield 140 may be formed from a plurality of discrete segments or portions positioned adjacent to one another along a longitudinal length of the cable 100. In the event that discrete segments or portions are utilized, in certain embodiments, gaps or spaces may exist between adjacent segments or portions. In other embodiments, certain segments may overlap one another. For example, an overlap may be formed between segments positioned adjacent to one another in a longitudinal direction.

As desired, a wide variety of suitable techniques and/or processes may be utilized to form a shield 140 (or a shield segment). For example, a base material or dielectric material may be extruded, poltruded, or otherwise formed. Electrically conductive material or other shielding material may then be applied to the base material. In other embodiments, shielding material may be injected into the base material. In yet other embodiments, dielectric material may be formed or extruded over shielding material in order to form a shield 140. Indeed, a wide variety of suitable techniques may be utilized to incorporate shielding material into a shield 140. In certain embodiments, the base layer may have a substantially uniform composition and/or may be made of a wide range of materials. Additionally, the base layer may be fabricated in any number of manufacturing passes, such as a single manufacturing pass. Further, the base layer may be foamed, may be a composite, and/or may include one or more strength members, fibers, threads, or yarns. As desired, flame retardant material, smoke suppressants, and/or other desired substances may be blended or incorporated into the base layer.

In certain embodiments, the shield 140 (or individual shield segments) may be formed as a tape that includes both a dielectric layer and an electrically conductive layer (e.g., copper, aluminum, silver, an alloy, etc.) formed on one or both sides of the dielectric layer. Examples of suitable materials that may be used to form a dielectric layer include, but are not limited to, various plastics, one or more polymeric materials, one or more polyolefins (e.g., polyethylene, polypropylene, etc.), one or more fluoropolymers (e.g., fluorinated ethylene propylene ("FEP"), polyester, polytetrafluoroethylene, polyimide, or some other polymer, combination of polymers, aramid materials, or dielectric material(s) that does not ordinarily conduct electricity. In certain embodiments, a separate dielectric layer and electrically conductive layer may be bonded, adhered, or otherwise joined (e.g., glued, etc.) together to form the shield 140. In other embodiments, electrically conductive material may be formed on a dielectric layer via any number of suitable techniques, such as the application of metallic ink or paint, liquid metal deposition, vapor deposition, welding, heat fusion, adherence of patches to the dielectric, or etching of patches from a metallic sheet. In certain embodiments, the conductive patches can be over-coated with an electrically insulating film, such as a polyester coating. Additionally, in certain embodiments, an electrically conductive layer may be sandwiched between two dielectric layers. In other embodiments, at least two electrically conductive layers may be combined with any number of suitable dielectric layers to form the shield 140. For example, a four layer construction may include respective electrically conductive layers formed on either side of a first dielectric layer. A second dielectric layer may then be formed on one of the electrically conductive layers to provide insulation between the electrically conductive layer and the twisted pairs 105A-D. Indeed, any number of suitable layers of material may be utilized in a shield 140.

Additionally, in certain embodiments, one or more separator elements (not shown) may be positioned between the individual conductors of a twisted pair 105. As desired, shielding material may be optionally incorporated into one or more separator elements positioned between the conductors of respective twisted pairs 105A-D. In certain embodiments, a twisted pair separator may be woven helically with the individual conductors or conductive elements of an associated twisted pair 105. In other words, a separator element may be helically twisted with the conductors of a twisted pair 105 along a longitudinal length of the cable 100.

Each separator element may have a wide variety of suitable constructions, components, and/or cross-sectional shapes. For example, each separator element may be formed as a dielectric film that is positioned between the two conductors of a twisted pair 105. In other embodiments, a separator element may be formed with an H-shape, an X-shape, or any other suitable cross-sectional shape. For example, the separator element may be formed to create or define one or more channels in which the twisted pair conductors may be situated. In this regard, the separator element may assist in maintaining the positions of the twisted pair conductors when stresses are applied to the cable, such as pulling and bending stresses. Additionally, in certain embodiments, a separator element may include a first portion positioned between the conductors of a twisted pair 105 and one or more second portions that form a shield around an outer circumference of the twisted pair. The first portion may be helically twisted between the conductors, and the second portion(s) may be helically twisted around the conductors as the separator and the pair 105 are twisted together. The first portion or dielectric portion may assist in maintaining spacing between the individual conductors of the twisted pair 105 and/or maintaining the positions of one or both of the individual conductors. The second portion(s) or shielding portions may extend from the first portion, and the second portion(s) may be individually and/or collectively wrapped around the twisted pair conductors in order to form a shield layer.

As set forth above, a wide variety of different components (e.g., a shield layer 140, the separator 125, etc.) of a cable 100 may function as shielding elements. In certain embodiments, the electrically conductive material or other shielding material incorporated into a shield element may be relatively continuous along a longitudinal length of a cable. For example, a relatively continuous foil shield or braided shield may be utilized. As another example, longitudinally continuous shielding material may be incorporated into the separator 125. In other embodiments, a shield element may be formed as a discontinuous shield element having a plurality of isolated patches of shielding material. For example, a plurality of discontinuous patches of electrically conductive material may be incorporated into the shield element (or into various components of a shield element), and gaps or spaces may be present between adjacent patches in a longitudinal direction. A wide variety of different patch patterns may be formed as desired in various embodiments, and a patch pattern may include a period or definite step. In other embodiments, patches may be randomly formed or situated on a base or carrier layer.

A wide variety of suitable shielding materials may be utilized to form patched of shielding material. Examples of suitable electrically conductive materials that may be utilized include, but not limited to, metallic material (e.g., silver, copper, nickel, steel, iron, annealed copper, gold, aluminum, etc.), metallic alloys, conductive composite materials, etc. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. Each electrically conductive patch may have any desired thickness. A wide variety of patch lengths (e.g., lengths along a longitudinal direction of a cable) may also be utilized. As desired, the dimensions of the segments and/or electrically conductive patches can be selected to provide electromagnetic shielding over a specific band of electromagnetic frequencies or above or below a designated frequency threshold.

Additionally, in a discontinuous shield, individual patches may be separated from one another so that each patch is electrically isolated from the other patches. That is, the respective physical separations between the patches may impede the flow of electricity between adjacent patches. In certain embodiments, the physical separation of patches may be formed by gaps or spaces, such as gaps of dielectric material. In other embodiments, the physical separation of certain patches may result from the overlapping of shield segments. For example, a shield element may be formed from a plurality of discrete segments, and adjacent segments may overlap one another. The respective physical separations between the patches may impede the flow of electricity between adjacent patches. A wide variety of suitable gap distances or isolation gaps may be provided between adjacent patches. In certain embodiments, patches may be formed as first patches (e.g., first patches on a first side of a dielectric material), and second patches may be formed on an opposite side of a dielectric base layer. For example, second patches may be formed to correspond with the gaps or isolation spaces between the first patches. As desired, patches may have a wide variety of different shapes and/or orientations. For example, the segments and/or patches may have a rectangular, trapezoidal, or parallelogram shape.

As desired in various embodiments, a wide variety of other materials may be incorporated into the cable 100. For example, as set forth above, a cable may include any number of conductors, twisted pairs, optical fibers, and/or other transmission media. As desired, a cable may include a wide variety of strength members, swellable materials (e.g., aramid yarns, blown swellable fibers, etc.), insulating materials, dielectric materials, flame retardants, flame suppressants or extinguishants, gels, and/or other materials. The cable 100 illustrated in FIG. 1 is provided by way of example only. Embodiments of the disclosure contemplate a wide variety of other cables and cable constructions. These other cables may include more or less components than the cable 100 illustrated in FIG. 1. Additionally, certain components may have different dimensions and/or materials than the components illustrated in FIG. 1.

FIGS. 2-4 are cross-sectional views of other example twisted pair cables 200, 300, 400 that include separators having a combination of solid and foamed prongs or fins, according to illustrative embodiments of the disclosure. Each of these cables 200, 300, 400 may have components that are similar to those described above with reference to the cable 100 of FIG. 1. For example, each cable 200, 300, 400 may include a plurality of twisted pairs, a separator positioned between the twisted pairs, one or more optional shield layers, an outer jacket, and/or any other suitable components. However, each cable 200, 300, 400 illustrates a separator with a different configuration of solid and foamed prongs than that depicted in the cable 100 of FIG. 1.

Turning first to the cable 200 of FIG. 2, the separator 205 may include two prongs 210A, 210B formed from a solid polymeric material and two prongs 210C, 210D formed from a foamed polymeric material. However, in contrast to the separator 125 illustrated in FIG. 1, the two foamed prongs 210C, 210D may be positioned perpendicular to one another (e.g., extending in perpendicular directions from a central point or central portion) rather than positioned opposite to one another. As desired in various embodiments, any two perpendicularly adjacent prongs may be formed as foamed prongs.

With reference to FIG. 3, a cable 300 may include a cross-filler separator 305 with three prongs 310A, 310B, 310C, formed from a solid polymeric material and a single prong 310D formed form a foamed polymeric material. Any suitable prong may be formed from a foamed polymeric material as desired. Turning now to FIG. 4, a cable 400 may include a cross-filler separator 405 having three prongs 410A, 410C, 410D formed from foamed polymeric material and a single prong 410B formed from solid polymeric material. As desired in various embodiments, any suitable prong may be formed as a solid prong. Further, as set forth above with reference to FIG. 1, a wide variety of other components (e.g., transmission media, strength members, swellable materials, etc.) may be incorporated into any of the cables 200, 300, 400 of FIGS. 2-4 as desired in various embodiments. The cables 200, 300, 400 illustrated in FIGS. 2-4 are provided by way of example only. Embodiments of the disclosure contemplate a wide variety of other cables and cable constructions. These other cables may include more or less components than the cables 200, 300, 400 illustrated in FIGS. 2-4.

Figure 5A:
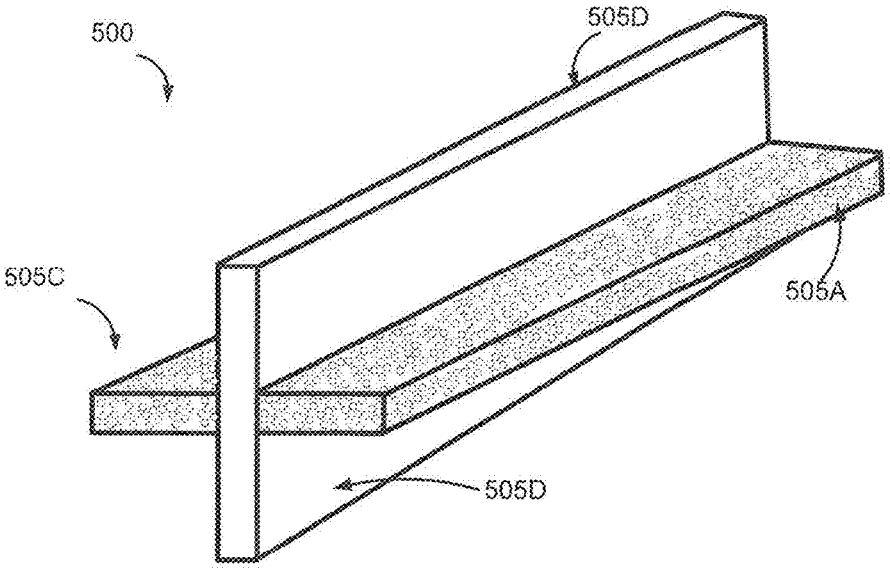
FIGS. 5A-5C depict cross-sectional views of a few example separator constructions that may be applied to separators having a combination of solid and foamed prongs, according to illustrative embodiments of the disclosure.
Figure 5B:
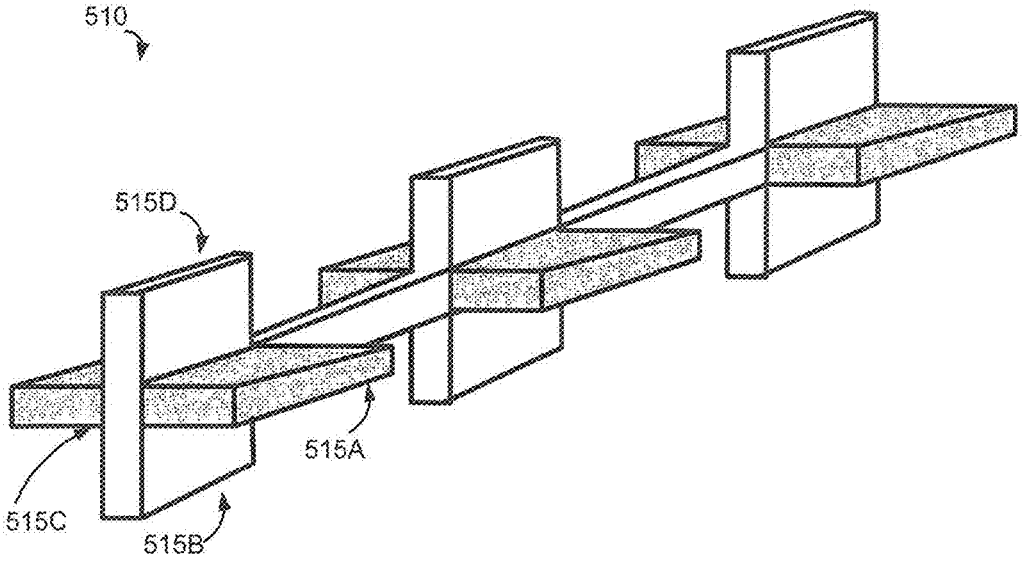
Figure 5C:
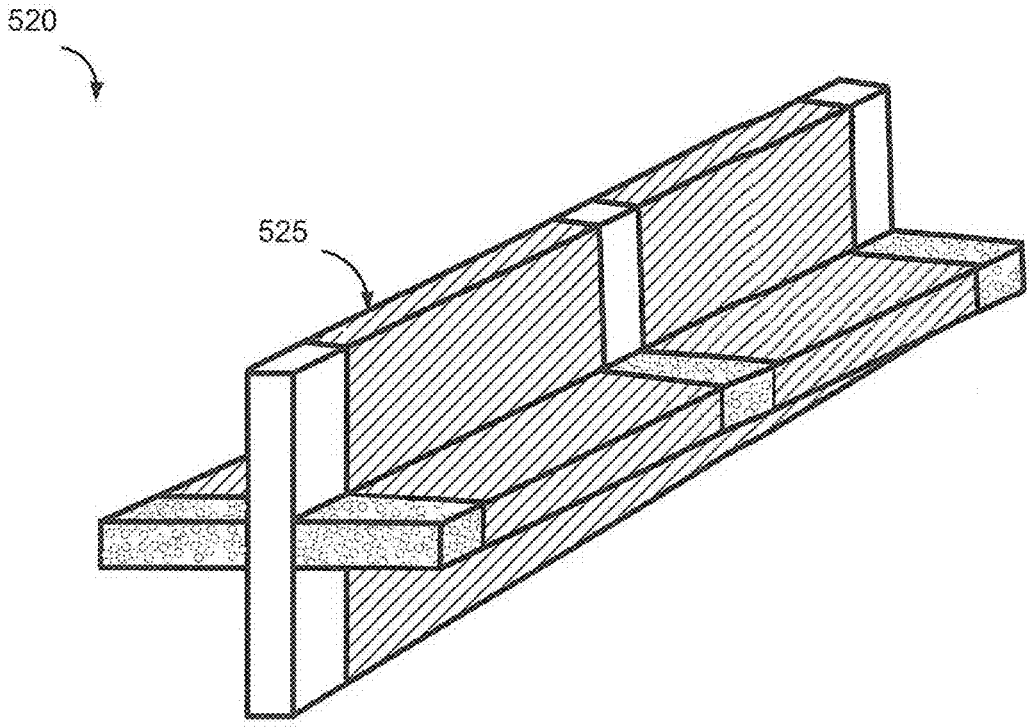

As set forth above with reference to FIG. 1, a separator 125 may be formed with a wide variety of suitable prong configurations and/or other features. FIGS. 5A-5C depict cross-sectional views of a few example separator constructions that may be applied to separators having a combination of solid and foamed prongs, according to illustrative embodiments of the disclosure. Although FIGS. 5A-5C depict example separator constructions having two oppositely positioned prongs formed from solid polymeric material and two oppositely positioned prongs formed from foamed polymeric material, features of the illustrated separator constructions may be equally applicable to separators with other configurations of solid and foamed prongs. For example, features of the illustrated separator constructions may be applicable to any of the separators 100, 200, 300, 400 illustrated in FIGS. 1-4, as well as to a wide variety of other suitable separators.

Turning first to FIG. 5A, a separator 500 having longitudinally continuous prongs is illustrated. Any suitable first portion or first subset of the prongs (e.g., prongs 505A, 505C) may be formed from foamed polymeric material. Additionally, any suitable second portion or second subset of the prongs (e.g., prongs 505B, 505D) may be formed from solid polymeric material. FIG. 5B illustrates a separator 510 having longitudinally spaced sets of prongs. In other words, rather than being longitudinally continuous, each prong may have longitudinally spaced sections with gaps or spaces formed between adjacent longitudinally spaced sections. Any suitable first portion or first subset of the prongs (e.g., prongs 515A, 515C) may be formed from foamed polymeric material. Additionally, any suitable second portion or second subset of the prongs (e.g., prongs 515B, 515D) may be formed from solid polymeric material. As described above with reference to FIG. 1, in other embodiments, various longitudinally spaced sections of a single prong may be formed from a combination of foamed and solid polymeric materials. In yet other embodiments, longitudinally continuous prongs may be formed with alternating sections of foamed and solid polymeric materials. In yet other embodiments, various longitudinally spaced sections of prongs may be formed with different directions of extension from a central portion. Indeed, a separator may be formed with a wide variety of suitable configurations of prongs.

FIG. 5C illustrates an example separator 520 that incorporates shielding material. For example, as illustrated in FIG. 5C, a plurality of discontinuous patches of shielding material 525 (e.g., electromagnetic shielding material, etc.) may be formed on an outer surface of the separator 520. As set forth above with reference to FIG. 1, a wide variety of suitable patch configurations may be utilized. Further, each patch may extend around any desired portion of the outer circumference of the separator 520. For example, as shown, each patch may extend around an entire outer circumference of the separator 525. In other embodiments, each patch may extend partially around an outer circumference of the separator 525. For example, longitudinally spaced patches may alternate their positions along the circumference of the separator 525 such that longitudinally adjacent patches are positioned between different sets of twisted pairs. A wide variety of suitable configurations of discontinuous patches may be utilized as desired in various embodiments. In other embodiments, longitudinally continuous patches of shielding material may be formed on an outer surface of the separator 520. In yet other embodiments, continuous and/or discontinuous shielding material may be embedded or otherwise incorporated into one or more prongs and/or other components of the separator 520. In yet other embodiments, the separator 520 may include one or more internal cavities or channels, such as a longitudinally continuous channel that facilitates cable cooling and positioning of one or more additional cable components (e.g., an optical fiber, etc.), and continuous and/or discontinuous shielding material may be formed on a surface of the one or more internal cavities. Indeed, a wide variety of different configurations of shielding material may be incorporated into a separator 520 as desired in various embodiments.

Separators may be formed with a wide variety of other suitable constructions and/or configurations as desired in other embodiments. The separators 500, 510, 520 illustrated in FIGS. 5A-5C are provided by way of non-limiting example only. Embodiments of the disclosure contemplate a wide variety of other separator constructions. These other separators may include more or less components than the separators 500, 510, 520 illustrated in FIGS. 5A-5C.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cable comprising:

a plurality of twisted pairs of individually insulated electrical conductors that extend along a longitudinal direction;

a cross-filler separator positioned between the plurality of twisted pairs, the separator comprising a plurality of prongs, each of the plurality of prongs having a uniform construction as it extends from a central portion of the separator between a respective set of adjacent pairs included in the plurality of twisted pairs, the separator comprising:

a first of the plurality of prongs formed from a foamed polymeric material; and a second of the plurality of prongs formed from a solid polymeric material, wherein, at any given cross-sectional location along a longitudinal length of the separator, no more than a single prong extends between any given set of adjacent pairs included in the plurality of twisted pairs; and a jacket formed around the plurality of twisted pairs and the separator.

2. The cable of claim 1, wherein the foamed polymeric material and the solid polymeric material comprise the same polymer.

3. The cable of claim 1, wherein the foamed polymeric material and the solid polymeric material comprise fluorinated ethylene propylene.

4. The cable of claim 1, wherein the plurality of twisted pairs comprises four twisted pairs and the plurality of prongs comprises four prongs.

5. The cable of claim 4, wherein a third of the plurality of prongs is formed from the foamed polymeric material and a fourth of the plurality of prongs is formed from the solid polymeric material.

6. The cable of claim 5, wherein the first and the third of the plurality of prongs extend from the central portion of the separator in perpendicular directions.

7. The cable of claim 5, wherein the first and the third of the plurality of prongs extend in opposite directions.

8. The cable of claim 4, wherein a third and a fourth of the plurality of prongs are formed from the foamed polymeric material.

9. The cable of claim 4, wherein a third and a fourth of the plurality of prongs are formed from the solid polymeric material.

10. A cable comprising:

four twisted pairs of individually insulated electrical conductors that extend along a longitudinal direction;

a separator positioned between the twisted pairs, the separator comprising four prongs, each of the prongs comprising a uniform construction as it extends from a central portion of the separator between a respective set of adjacent pairs included in the four twisted pairs, the separator comprising:

a first of the four prongs formed from a foamed polymeric material; and a second of the four prongs formed from a solid polymeric material, wherein, at any given cross-sectional location along a longitudinal length of the separator, no more than a single prong extends between any given set of adjacent pairs included in the plurality of twisted pairs; and a jacket formed around the four twisted pairs and the separator.

11. The cable of claim 10, wherein the foamed polymeric material and the solid polymeric material comprise fluorinated ethylene propylene.

12. The cable of claim 10, wherein a third of the four prongs is formed from the foamed polymeric material and a fourth of the four prongs is formed from the solid polymeric material.

13. The cable of claim 12, wherein the first and the third of the four prongs extend in opposite directions.

14. The cable of claim 12, wherein the first and the third of the four prongs extend in perpendicular directions.

15. The cable of claim 10, wherein a third and a fourth of the four prongs are formed from the foamed polymeric material.

16. The cable of claim 10, wherein a third and a fourth of the four prongs are formed from the solid polymeric material.

17. A cable comprising:

four twisted pairs of individually insulated electrical conductors that extend along a longitudinal direction;

a separator positioned between the twisted pairs, the separator comprising four prongs, each of the prongs comprising a uniform construction as it extends from a central portion of the separator between a respective set of adjacent pairs included in the four twisted pairs, the separator comprising:

a first of the four prongs formed from foamed fluorinated ethylene propylene; and a second of the four prongs formed from solid fluorinated ethylene propylene, wherein, at any given cross-sectional location along a longitudinal length of the separator, no more than a single prong extends between any given set of adjacent pairs included in the plurality of twisted pairs; and a jacket formed around the four twisted pairs and the separator.

18. The cable of claim 17, wherein a third of the four prongs is formed from foamed fluorinated ethylene propylene and a fourth of the four prongs is formed from solid polymeric fluorinated ethylene propylene.

19. The cable of claim 17, wherein a third and a fourth of the four prongs are formed from foamed fluorinated ethylene propylene.

20. The cable of claim 17, wherein a third and a fourth of the four prongs are formed from solid fluorinated ethylene propylene.

* * * * *